US006994044B2

(12) United States Patent
Kwon

(10) Patent No.: US 6,994,044 B2
(45) Date of Patent: Feb. 7, 2006

(54) EMBROIDERED PATCH AND MANUFACTURING METHOD THEREFOR

(75) Inventor: Jeong Chul Kwon, Seoul (KR)

(73) Assignee: DADA Corp., Seoul (KR)

( * ) Notice: Subject to any disclaimer, the term of this patent is extended or adjusted under 35 U.S.C. 154(b) by 149 days.

(21) Appl. No.: 10/714,919

(22) Filed: Nov. 18, 2003

(65) Prior Publication Data

US 2005/0103248 A1 May 19, 2005

(51) Int. Cl.
*D05C 17/00* (2006.01)

(52) U.S. Cl. ..... 112/475.18; 112/439

(58) Field of Classification Search ..... 112/475.01, 112/475.09, 475.18, 475.12, 475.22, 100, 112/78, 101, 439, 441; 2/244, 246; 156/91, 156/93

See application file for complete search history.

(56) References Cited

U.S. PATENT DOCUMENTS 1,221,440 A * 4/1917 Gottschalk ..... 2/244
4,103,634 A * 8/1978 Schachter ..... 112/439
4,517,910 A * 5/1985 Jalowsky ..... 112/439
5,136,726 A 8/1992 Kellin et al.
5,147,129 A 9/1992 Ku
5,241,919 A * 9/1993 LaGreca ..... 112/410
5,359,733 A 11/1994 Brannon et al.
5,359,734 A 11/1994 Rathburn
5,832,854 A * 11/1998 Lin et al. ..... 112/475.22
5,924,139 A 7/1999 Van Den Heuvel
6,178,680 B1 * 1/2001 Sloot ..... 40/668
6,718,895 B1 * 4/2004 Fortuna ..... 112/475.19

* cited by examiner

*Primary Examiner*—Ismael Izaguirre

(57) ABSTRACT

In manufacturing embroidered patch attached to the apparel like cap, bag, clothes and others, the present invention makes it possible to reduce the process and to improve the productivity amazingly.

The embroidered patch and the manufacturing method thereof according to the present invention has the feature that it comprises the embroidery portion embroidering non-woven fabric having a certain thickness and the edge portion sewn along the circumference line of said embroidery portion. 1~2 mm thickness of soft material may be added to said non-woven fabric for thicker embroidered patch. For said soft material, EVA(Ethylene Vinyl Acetate) is usually used and the embroidered patch is completed by detaching the non-woven fabric and the soft material which is not embroidered.

7 Claims, 2 Drawing Sheets

EMBROIDERED PATCH AND MANUFACTURING METHOD THEREFOR

BACKGROUND OF THE INVENTION

1. Field of the Invention

The present invention relates to an embroidered patch and the manufacturing method thereof for the item such as cap, clothes, bag and others and, more particularly, to the embroidered patch which is designed to reduce the manufacturing process and to enhance the productivity.

2. Description of the Prior Art

Patch has been developed from the symbol and ornament used on the shields of the knight from the middle ages. It has been used on various kinds of apparel including clothes, cap, bag and others along with the increase of its application and the availability of manufacturing many kinds of patches like characters, numbers, figures, pictures, etc.

One of the patches being used is the embroidered one in which embroidery yarn is used. The patch is embroidered along the preset line of clothes or sole sheets according to the design of a user. It, then, is cut along the circumference line of said patch and it is sewn in zigzag by sewing machines.

However, because the above conventional manufacturing method of embroidered patch had troublesome cutting process, improvement of the process as well as productivity has been necessary.

SUMMARY OF THE INVENTION

The main object of the present invention is to resolve the problems that the current art has had and the main purpose is to reduce the process and to fundamentally improve the productivity.

In accordance with this object, the embroidered patch of the present invention consists of non-woven fabric having a certain thickness, the embroidery portion embroidering said non-woven fabric in stitching yarns along a desired figure, and the edge portion sewn along the circumference line of said embroidery portion. In case of thicker embroidered patch, soft material, for which EVA(Ethylene Vinyl Acetate) is usually used, may be applied to said non-woven fabric for said embroidered patch, and 1~2 mm of thickness is appropriate for the soft material.

Said embroidered patch features that the non-woven fabric as well as soft material is directly embroidered using stitching yarns, and the circumference line is also sewn without the need of cutting and zigzag stitching the outline, which has been used in the current art.

DESCRIPTION OF THE PREFERRED EMBODIMENT

Figure 1:
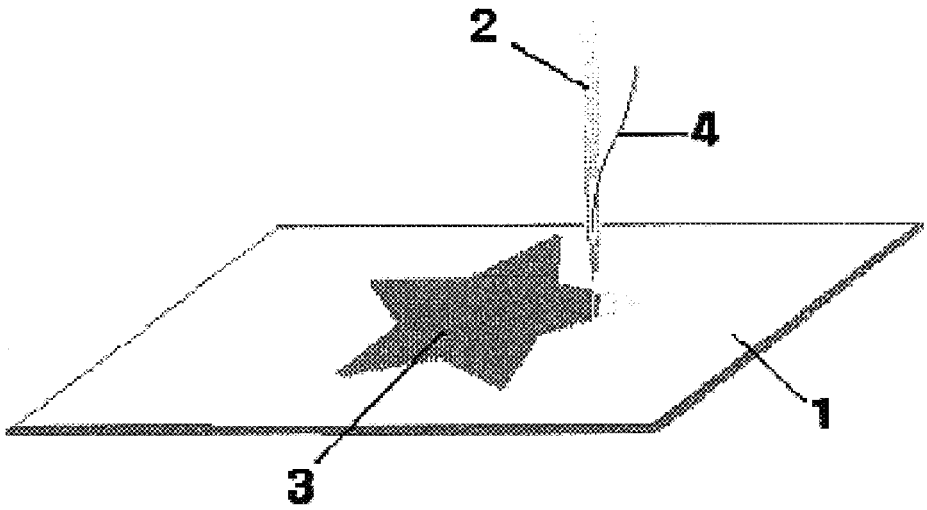
FIG. 1 is a perspective view of the embroidering process according to the present invention.

Although only a preferred embodiment of the invention is explained in detail, and it is to be understood that the embodiment is given by way of illustration only, it is not intended that the invention is to be limited in its scope to the details of construction and arrangement of components set forth in the following description of illustrated in the drawings. This invention is capable of other embodiment and of being practiced or carried out in various ways.

Figure 2:
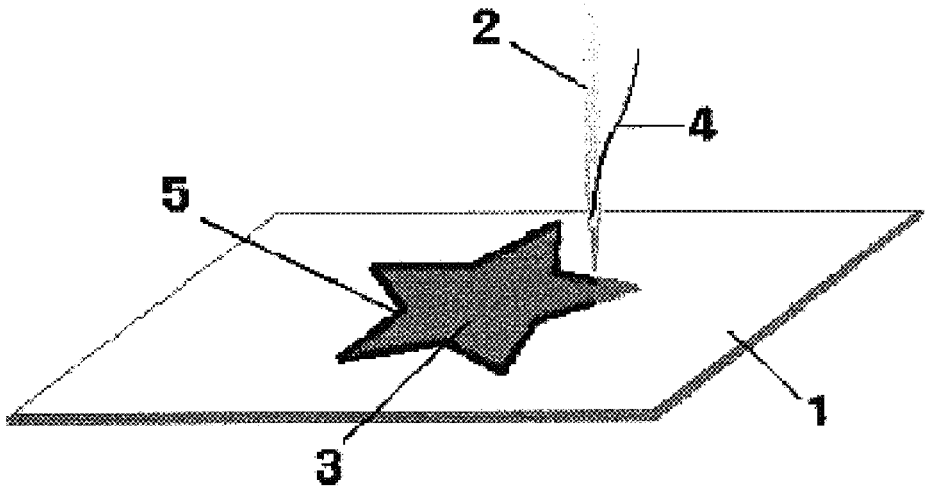
FIG. 2 is a perspective view of the sewing outlining process according to the present invention.

In accordance with the preferred embodiment of the present invention, FIG. 1 is a perspective view of the embroidering process according to the present invention and FIG. 2 is a perspective view of the outlining process according to the present invention. As shown on the figures, non-woven fabric (1) having a certain thickness is basically used for making the embroidered patch. For the material on which the patch is attached, including said non-woven fabric, any material, which may be easily detached after being embroidered in stitching yarns, may be used. And also if thicker embroidered patch is needed, soft material may be added on said non-woven fabric, and EVA is usually used when 1~2 mm of thickness is appropriate for it. the embroidery portion (3) is finished as a form of embroidering said non-woven fabric (1) in stitching yarns (4) along a desired figure (3) by the user using embroidery needle (2) of the embroidery machine, and then, the edge portion (5) is finished by sewing along the circumference edge line of the embroidery portion (3).

Figure 3:
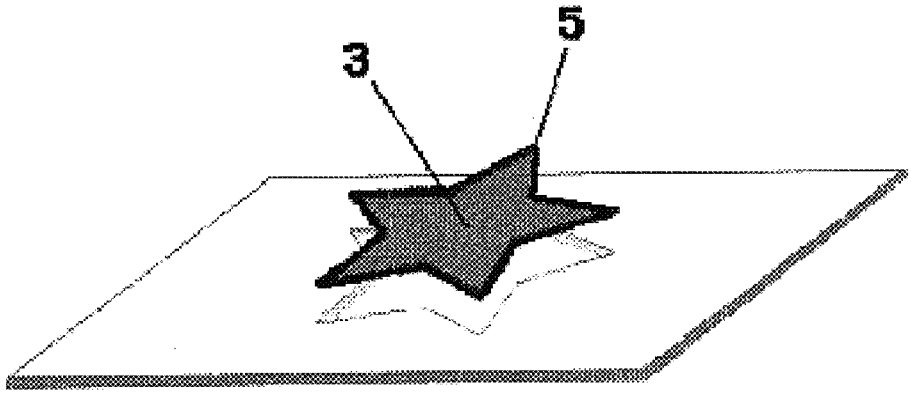
FIG. 3 is a completed view of the embroidered patch according to the present invention.

FIG. 3 is a finished view of the embroidered patch according to the present invention. As shown on the figure, the embroidered patch is completed by detaching the rest of non-woven fabric, which is not embroidered, after finishing sewing along the circumference edge line of said embroidery portion (3). The embroidered patch comprises said embroidery portion (3) and said edge portion (5).

Figure 4:
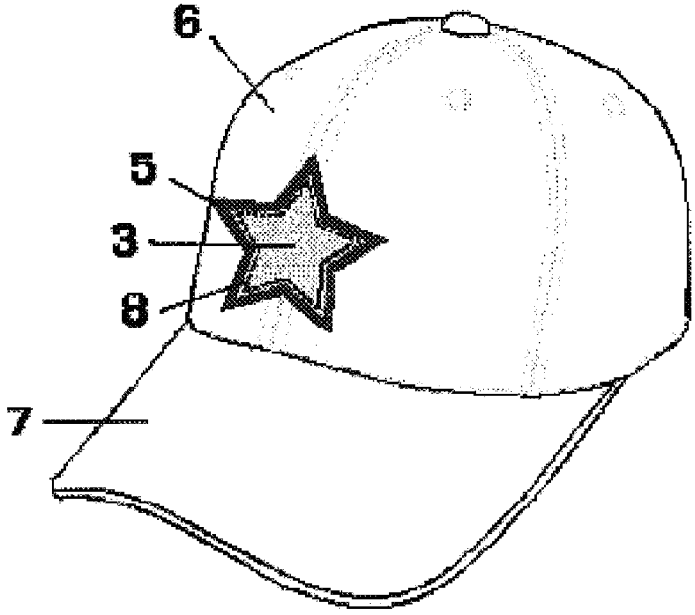
FIG. 4 is a perspective view of a cap on which the embroidered patch is attached according to the present invention.

FIG. 4 is a perspective view of a cap on which the embroidered patch is applied according to the present invention. As shown on the figure, the embroidered patch according to the present invention may be applied to various apparel, and in case of the cap that said embroidered patch is applied, said embroidered patch is attached onto the front of the cap comprising the crown (6), which is main part of the cap and is made of several panels, and the visor (7), which is attached to under part in front of said crown, by sewing. Said embroidered patch may be applied to other item like clothes and bag including cap.

What is claimed is:

1. An embroidered patch comprising:

non-woven fabric having a certain thickness;

1~2 mm thickness of soft material on the non-woven fabric;

the embroidery portion embroidered non-woven fabric and soft material in stitching yarns along a desired figure, and the edge portion sewn along the circumference line of said embroidery portion, and the embroidered patch is completed by detaching the rest of non-woven fabric and soft material, which is not embroidered, except said embroidery portion with the edge portion.

2. The embroidered patch as set forth in claim 1, wherein said embroidered patch is attached to cap by sewing.

3. The embroidered patch as set forth in claim 1, wherein said embroidered patch is attached to bag by sewing.

4. The embroidered patch as set forth in claim 1, wherein said embroidered patch is attached to clothes by sewing.

5. The embroidered patch as set forth in claim 1, wherein said soft material is Ethylene Vinyl Acetate.

6. A method of manufacturing a embroidered patch comprising;

preparing non-woven fabric having a certain thickness;

laying soft material on said non-woven fabric;

embroidering said non-woven fabric and soft material in stitching yarns along a desired figure;

sewing along the circumference edge line of said embroidered non-woven fabric and soft material;

detaching the rest of non-woven fabric and soft material, which is not embroidered, except said embroidered non-woven fabric and soft material with said sewn circumference edge line.

7. An embroidered patch comprising:

non-woven fabric having a certain thickness;

the embroidery portion embroidered said non-woven fabric in stitching yarns along a desired figure, and the edge portion sewn along the circumference line of said embroidered portion, and the embroidered patch is completed by detaching the rest of non-woven fabric, which is not embroidered, except said embroidery portion with the edge portion.

* * * * *